US008801153B2

(12) United States Patent
Hayashi

(10) Patent No.: US 8,801,153 B2
(45) Date of Patent: Aug. 12, 2014

(54) LIQUID DROP EJECTING HEAD, IMAGE FORMING DEVICE, AND METHOD OF MANUFACTURING LIQUID DROP EJECTING HEAD

(71) Applicant: Keisuke Hayashi, Kanagawa (JP)

(72) Inventor: Keisuke Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/804,625

(22) Filed: Mar. 14, 2013

(65) Prior Publication Data

US 2013/0242004 A1 Sep. 19, 2013

(30) Foreign Application Priority Data

Mar. 19, 2012 (JP) ..... 2012-062096
Nov. 5, 2012 (JP) ..... 2012-243511

(51) Int. Cl.
*B41J 2/045* (2006.01)

(52) U.S. Cl.
USPC ..... 347/70

(58) Field of Classification Search
CPC .... B41J 2/14233; B41J 2/161; B41J 2/14201; B41J 2202/11; B41J 2/14274; B41J 2002/14403
USPC ..... 347/70, 71, 93
See application file for complete search history.

(56) References Cited

U.S. PATENT DOCUMENTS 5,489,930 A * 2/1996 Anderson ..... 347/71
8,070,279 B2 * 12/2011 Miura ..... 347/93

FOREIGN PATENT DOCUMENTS

JP 2007-229949 9/2007
JP 2007-253439 10/2007
JP 2008-213196 9/2008

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

In a liquid drop ejecting head including a diaphragm, a channel member, and a nozzle plate which are laminated in this order, interface surfaces of the channel member and the diaphragm are bonded by an adhesive. The diaphragm is formed to have a laminated structure in which the number of lamination layers is varied at different locations. The diaphragm includes an opening and a filter part, the filter part having plural filtering holes formed in the opening for supplying a liquid to pressurizing liquid chambers of the channel member. A side wall of the channel member disposed to contact or located in a vicinity of the filter part, and a thick-walled portion containing the largest number of lamination layers in the diaphragm do not overlap with each other in a laminating direction.

8 Claims, 15 Drawing Sheets

LIQUID DROP EJECTING HEAD, IMAGE FORMING DEVICE, AND METHOD OF MANUFACTURING LIQUID DROP EJECTING HEAD

BACKGROUND OF THE INVENTION

1. Field of the Invention

The present disclosure relates to a liquid drop ejecting head, an image forming device including a liquid drop ejecting head, and a method of manufacturing a liquid drop ejecting head.

2. Description of the Related Art

Generally, an image forming device including a liquid drop ejecting head to eject liquid drops, such as ink, is known as one of various image forming devices, including printers, fax devices, copiers, plotters, multi-function peripherals, etc. In this image forming device, the liquid drop ejecting head ejects ink drops to a print medium which is intermittently transported, so that an image is formed on the print medium by the ink drops adhering thereto.

In the following, the print medium on which the image is formed by the image forming device of the liquid drop ejecting type may include printing sheets (paper), thread, fibers, textile, leather, metal, plastics, glass, wood, and ceramics. The image formation performed by the image forming device of the liquid drop ejecting type may include image formation of meaningful images, such as characters or figures, and image formation of meaningless images, such as patterns, (or liquid drops are ejected to the target object).

The ink used in the image forming device of the liquid drop ejecting type may include a printing liquid, a fixing process solution and any other liquid, which are commonly used to perform image formation, and may further include DNA samples, resist materials, pattern materials, resins, etc.

The image formed by the image forming device of the liquid drop ejecting type may include two-dimensional images, three-dimensionally formed images, and images of three-dimensionally formed solid models.

Conventionally, there is known a piezoelectric liquid drop ejecting head which includes plural liquid chambers individually arranged for plural nozzles arrayed in parallel to eject ink drops. In this piezoelectric liquid drop ejecting head, a diaphragm is formed at a part of a wall surface of each of the liquid chambers. The diaphragm is deformed by a pressure generating means, such as a piezoelectric element, and the volume of the liquid chamber is changed to eject an ink drop from the nozzle.

In recent years, in order to meet the demand for a high level of image quality in image forming devices, reduction of ink drop size has been proposed. In order to eject an ink drop the volume of which ranges from several picoliters (pL) to several tens of picoliters (pL) from a minute nozzle straightly with good stability, it is important to prevent the inclusion of foreign substances in the liquid drop ejecting head.

If a foreign substance mixed in an ink manufacturing process or a foreign substance adhering to an ink supply module is present, the foreign substance is moved to the nozzle by liquid drops so that the nozzle may be clogged with the foreign substance (which causes insufficient ejection) or the foreign substance may partially adhere to the nozzle end (which causes ejection deviation).

In order to prevent occurrence of insufficient ejection due to foreign substances, a method of arranging a filter for capturing foreign substances in a liquid drop ejecting head is known. For example, see Japanese Laid-Open Patent Publication No. 2008-213196.

This filter is arranged in the vicinity of a nozzle as close as possible, the area in which cleanliness can be secured is narrowed by the filter, and it is possible to maintain the cleanliness stably at a high level. Japanese Laid-Open Patent Publication No. 2008-213196 discloses a liquid drop ejecting head in which a filter part is formed in a diaphragm component that forms one wall surface of a pressurizing liquid chamber as an ink passage.

FIG. 16 shows a liquid drop ejecting head disclosed in Japanese Laid-Open Patent Publication No. 2008-213196. As shown in the area indicated by a dotted line in FIG. 16, a portion of a channel member 1 adjacent to a filter part 9 is arranged to overlap with a 3-layered structure portion of a diaphragm 2, and the channel member 1 portion is mounted on the diaphragm 2 portion in the laminating direction thereof.

In a method of manufacturing the above liquid drop ejecting head, in order to secure a bonding strength of the channel plate and the diaphragm, pressure bonding is performed on the diaphragm 3-layered structure portion and the channel plate portion overlapping in the laminating direction by using an upper pressurizing jig on the top of the channel plate and a lower pressurizing jig on the bottom of the diaphragm, respectively.

However, in a case of the pressure bonding method, an adhesive applied between the channel member and the diaphragm may flow out due to the pressurization. If the adhesive reaches the filter part formed in the diaphragm, the adhesive passes through the filtering holes by the capillary effect and such adhesive flows out. The adhesive may stick to the pressurizing jigs, and the yield may fall.

SUMMARY OF THE INVENTION

In one aspect, the present disclosure provides a liquid drop ejecting device in which a bonding strength needed between a diaphragm and a channel member is secured and the outflow of an adhesive for bonding is prevented.

In an embodiment which solves or reduces one or more of the above-mentioned problems, the present disclosure provides a liquid drop ejecting device including: a nozzle plate that forms nozzles to eject liquid drops; a channel member that forms pressurizing liquid chambers which communicate with the nozzles, respectively; and a diaphragm that forms a bottom surface of each of the pressurizing liquid chambers, the diaphragm, the channel member and the nozzle plate being laminated in this order, wherein: interface surfaces of the channel member and the diaphragm are bonded by an adhesive; the diaphragm is formed to have a laminated structure in which the number of lamination layers is varied at different locations of the diaphragm; the diaphragm includes an opening and a filter part, the filter part having plural filtering holes formed in the opening for supplying a liquid to the pressurizing liquid chambers; and a side wall of the channel member is disposed to contact or located in a vicinity of the filter part, and the side wall and a thick-walled portion containing the largest number of lamination layers in the diaphragm do not overlap with each other in a laminating direction.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the accompanying drawings.

Figure 1:
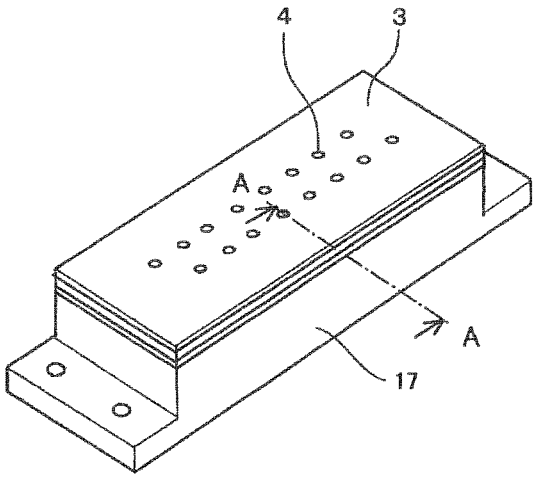
FIG. 1 is a perspective view of a liquid drop ejecting head of a first embodiment of the present disclosure.
Figure 2:
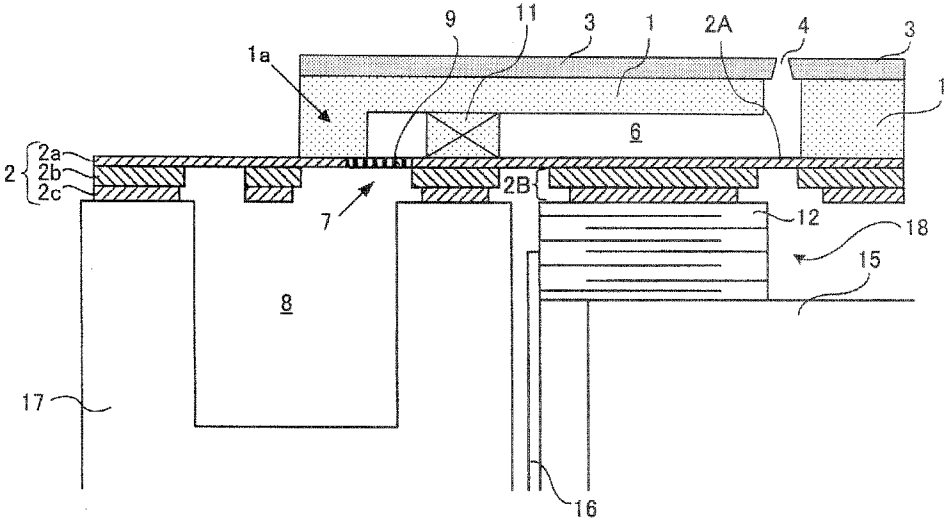
FIG. 2 is a cross-sectional diagram of the liquid drop ejecting head of the first embodiment taken along a line A-A indicated in FIG. 1 in a direction perpendicular to a nozzle arraying direction.

FIG. 1 is a perspective view of a liquid drop ejecting head of a first embodiment of the present disclosure. FIG. 2 is a cross-sectional diagram of the liquid drop ejecting device taken along a line A-A indicated in FIG. 1 in a direction (a longitudinal direction of a liquid chamber) which is perpendicular to a nozzle arraying direction.

As shown in FIG. 2, the liquid drop ejecting head of the first embodiment generally includes a nozzle plate 3 which forms nozzles 4 to eject liquid drops, a channel member 1 which forms pressurization liquid chambers 6 which communicate with the nozzles 4, respectively, and a diaphragm 2 which forms a bottom surface of each pressurization liquid chamber 6 in the liquid drop ejecting head. The diaphragm 2, the channel member 1, and the nozzle plate 3 are laminated in this order.

The channel member 1 and the diaphragm 2 are bonded by an adhesive.

This liquid drop ejecting head further includes a liquid supply passage 11 which functions as a fluid resistance part to supply liquid to the pressurization liquid chamber 6, a base member 15, a feeder 16 which is connected to a piezoelectric component 12, a common liquid chamber 8, and a frame member 17 which forms the common liquid chamber 8.

The liquid from the common liquid chamber 8 (which is a common passage of the frame member 17) is supplied to the plural pressurization liquid chambers 6 through the liquid supply passage 11 and a filter part 9 (which is formed in the diaphragm 2).

For example, the nozzle plate 3 is formed of a metal plate of nickel (Ni) and produced by an electroforming method. However, the present disclosure is not limited to this example, and another metal plate, a resin plate, a laminated member containing a resin layer and a metal layer, etc., may be used to produce the nozzle plate 3. In the nozzle plate 3, the nozzles 4 are formed each having a diameter in a range of, for example, 10-35 micrometers (μm) and communicating with a corresponding one of the pressurization liquid chambers 6. The nozzle plate 3 is bonded to the channel member 1 by the adhesive. In a liquid drop ejecting surface of this nozzle plate 3 (a surface of the nozzle plate 3 in the ejection direction opposite to the pressurization liquid chamber 6 side), a water-repellent layer is formed.

The channel member 1 is formed with opening portions which are produced by etching of a single-crystal silicon substrate. Each of the opening portions in the channel member 1 constitutes a part of the pressurization liquid chamber 6 and the liquid supply passage 11. For example, the channel member 1 may be formed by etching of a metal plate, such as an SUS (stainless steel) plate, using an acid etching solution. Alternatively, the channel member 1 may be formed by machining of a metal plate, such as a press forming process.

The diaphragm 2 is formed to have a laminated structure in which the number of lamination layers is varied at different locations of the diaphragm 2. In the example of FIG. 1, the diaphragm 2 is formed to have a three-layered structure including a first layer 2*a*, a second layer 2*b* and a third layer 2*c* which are made of nickel plates and laminated from the pressurization liquid chamber 6 side. For example, the diaphragm 2 is produced by electroforming.

As shown in FIG. 2, an opening 7 is formed in the first layer 2*a* of the diaphragm 2, and the liquid from the common liquid chamber 8 can be supplied to the pressurization liquid chamber 6 via the opening 7. In this opening 7, the filter part 9 is formed for filtering the liquid for all the areas of the plural pressurization liquid chambers 6 in the nozzle arraying direction. In this filter part 9, plural filtering holes (or communication holes) are alternately arrayed in a zigzag formation or in a lattice formation. Each of the filtering holes which constitute the filter part 9 is formed to have an internal cross-section in a tapered form or a horn-like shape at its outlet edge. Each of the filtering holes has an inside diameter on the side of the channel member 1 which is equal to or smaller than an inside diameter of the nozzle 4.

The diaphragm 2 includes a deformable oscillation area 2A which is formed in a portion of the first layer 2*a* corresponding to the pressurization liquid chamber 6, and this oscillation area 2A also functions as a surface member to form a surface of the pressurization liquid chamber 6 of the channel member 1. In the middle of the oscillation area 2A, a projection 2B having a two-layered structure of the second and third layers 2*b* and 2*c* is formed, and a piezoelectric component 12 which constitutes a piezoelectric actuator 18 (which will be described later) is bonded to the projection 2B.

The piezoelectric actuator 18 including an electromechanical transducer as an actuator means (or a pressure generating means) for actuating the oscillation area 2A of the diaphragm 2 is arranged on the bottom side of the diaphragm 2 opposite to the individual liquid chamber 6.

The piezoelectric actuator 18 includes plural laminated piezoelectric components 12 which are bonded to the base member 15 by an adhesive. A slot forming process is performed on the piezoelectric components 12 by half-cut dicing so that a necessary number of piezoelectric pillars (not illustrated) for each piezoelectric component 12 are formed at predetermined intervals in a comb-tooth pattern.

Although not illustrated, the piezoelectric pillars of the piezoelectric components 12 include driving piezoelectric pillars (drive pillars) which are electrically driven by applying a drive waveform to actuate the diaphragm, and non-driving piezoelectric pillars (non-drive pillars) which function as a mere support without being electrically driven. The drive pillars are bonded to the projection 2B formed in the oscillation area 2A of the diaphragm 2, and the non-drive pillars are bonded to another projection (not illustrated) of the diaphragm 2.

In each piezoelectric component 12, piezoelectric layers and internal electrodes are alternately laminated, and the internal electrodes are exposed to the end face of the piezoelectric component 12, respectively. External electrodes are formed on the internal electrodes at the end face of the piezoelectric component 12 and the feeder 16 is connected to the external electrodes for supplying a driving signal to the drive pillar via the external electrodes. The feeder 16 is a flexible wiring plate having flexibility.

For example, the frame member 17 is formed by injection molding of an epoxy base resin or a polyphenylenesulfite (which is a thermoplastic resin). The common liquid chamber 8 to which the liquid from a head tank or a liquid cartridge (which is not illustrated) is supplied is formed by the frame member 17.

For example, in the liquid drop ejecting head, when the voltage applied to the drive pillar is lowered from a reference voltage, the drive pillar is contracted, and the oscillation area 2A of the diaphragm 2 is lowered to increase the volume of the pressurization liquid chamber 6. At this time, the liquid flows into the pressurization liquid chamber 6. Thereafter, when the voltage applied to the drive pillar is increased, the drive pillar is expanded in the laminating direction. The oscillation area 2A of the diaphragm 2 is deformed in the direction toward the nozzle 4 to decrease the volume of the pressurization liquid chamber 6, so that the liquid in the pressurization liquid chamber 6 is pressurized to eject a liquid drop from the nozzle 4.

When the voltage applied to the drive pillar is returned to the reference voltage, the oscillation area 2A of the diaphragm 2 is returned to its initial position, and the pressurization liquid chamber 6 is expanded so that a negative pressure occurs therein. At this time, the liquid from the common liquid chamber 8 is supplied to the pressurization liquid chamber 6 through the liquid supply passage 11. Then, after vibration of the meniscus of the nozzle 4 is attenuated and the liquid surface is stabilized, the liquid drop ejecting head is shifted to operation for the following liquid drop ejection.

The method of driving the liquid drop ejecting head according to the present disclosure is not limited to the above-described example. Alternatively, the manner in which the drive waveform is applied may be modified to perform a different driving method.

Next, a bonded structure according to the first embodiment of the present disclosure will be described with reference to FIG. 3 and FIG. 4.

Figure 3:
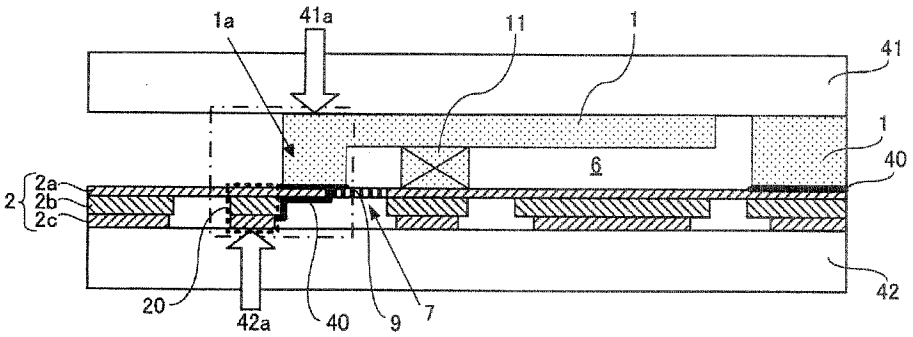
FIG. 3 is a diagram for explaining a bonded structure in which a diaphragm and a channel member are bonded according to the first embodiment.

FIG. 3 is a cross-sectional diagram for explaining a bonded structure in which the diaphragm 2 and the channel member 1 are bonded according to the first embodiment of the present disclosure. FIG. 4 is an enlarged diagram showing a portion of the liquid drop ejecting head indicated by a one-dot chain line in FIG. 3 for explaining the bonding of the diaphragm 2 and the channel member 1.

First, the composition of the bonding of the diaphragm 2 and the channel member 1 in the liquid drop ejecting head of the first embodiment will be described. As shown in FIG. 3, a thick-walled portion 20 (which is indicated by a dotted line in FIG. 3) is formed outside the outer side end of the filter part 9 in the longitudinal direction of the pressurizing liquid chamber 6. In the thick-walled portion 20, the first layer 2*a*, the second layer 2*b* and the third layer 2*c* are laminated, and this thick-walled portion 20 contains the largest number of lamination layers in the diaphragm 2. A side wail 1*a* is formed at the outer end portion of the channel member 1, and the side wall 1*a* is disposed to contact the filter part 9. Alternatively, the side wall 1*a* may be disposed in a vicinity of the filter part 9 without contacting the filter part 9.

As shown in FIG. 3, in the present embodiment, the thick-walled portion 20 is located nearer to the outer peripheral end of the liquid drop ejecting head than is the side wall 1*a* of the channel member 1, so that the thick-walled portion 20 and the side wall 1*a* do not overlap each other in the laminating direction of the components which form the liquid drop ejecting head. Namely, the thick-walled portion 20 is not located in a range of projection from the laminating direction of the components in the channel member 1.

An adhesive 40 is applied to the interface surfaces of the side wall 1*a* and the diaphragm 2 in order to bond the channel member 1 and the diaphragm 2.

In order to form the pressurization liquid chambers 6 which communicate with the nozzles 4, it is necessary to arrange the diaphragm 2 and the channel member 1 so that the bonded surface between the diaphragm 2 and the channel member 1 is sealed certainly. For this purpose, it is preferred to use, in a manufacturing process, a method of bonding only the two parts: the channel member 1 and the diaphragm 2. Hence, as shown in FIG. 3, a bottom surface of the diaphragm 2 and a top surface of the channel member 1 are sandwiched between upper and lower pressurizing jigs 41 and 42, and the downward pressure 41*a* is exerted on the top surface of the channel member 1 and the upward pressure 42*a* is exerted on the bottom surface of the diaphragm 2 simultaneously. Then, the adhesive 40 applied to the interface surfaces of the diaphragm 2 and the channel member 1 is hardened under pressure.

At this time, if the side wall 1*a* contacts the filter part 9 or is disposed in the vicinity of the filter part 9, the adhesive 40 applied to the interface surfaces of the side wall 1*a* and the diaphragm 2 may flow out to the thick-walled portion 20 through the filter part 9 by the pressurization.

Figure 5:
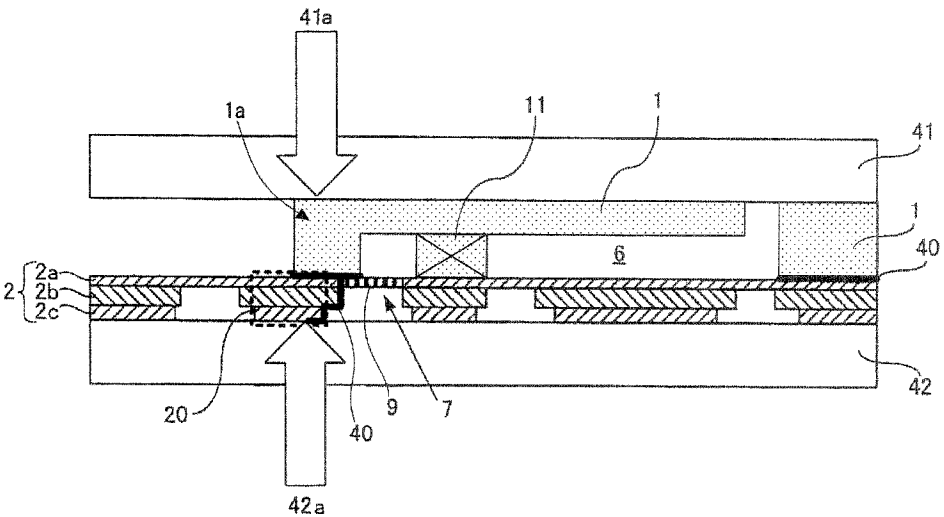
FIG.5 RELATED ART
FIG. 5 is a diagram for explaining a bonded structure in which a diaphragm and a channel member are bonded according to the related art.

For the purpose of understanding of the bonded structure of the liquid drop ejecting head according to the present disclosure, FIG. 5 shows a bonded structure in which a diaphragm and a channel member are bonded in a liquid drop ejecting head according to the related art.

In the composition shown in FIG. 5, in order to secure the bonding strength of the channel member 1 and the diaphragm 2, the liquid drop ejecting head according to the related art is arranged so that the side wall 1*a* and the thick-walled portion 20 overlap each other in the laminating direction of the components which constitute the liquid drop ejecting head. In this case, the downward pressure 41*a* exerted on the top surface of the channel member 1 confronts the upward pressure 42*a* exerted on the bottom surface of the diaphragm 2, thereby increasing the pressure exerted on the interface surfaces of the side wall 1*a* and the thick-walled portion.

However, in this composition, the outflow amount of the adhesive 40 increases and the adhesive flowing to the thick-walled portion 20 through the filtering holes of the filter part 9 may reach the lower pressurizing jig 42, and the diaphragm 2 and the lower pressurizing jig 42 are bonded improperly. Hence, when the lower pressurizing jig 42 is removed, the diaphragm 2 may be separated from the channel member 1 and defective bonding may arise.

As previously described, in the composition of the present embodiment, the liquid drop ejecting head is arranged so that the thick-walled portion 20 and the side wall 1*a* may not overlap each other in the laminating direction of the components which constitute the liquid drop ejecting head, as shown in FIG. 3. Therefore, as shown in FIG. 4, when the pressurizing channel member 1 and the diaphragm 2 are sandwiched between the pressurizing jigs 41 and 42, the exerted pressures 41*a* and 42*a* by the two pressurizing jigs do not confront each other and the directions of the exerted pressures 41*a* and 42*a* are not consistent with each other.

In the present embodiment, the side wall 1*a* of the channel member 1 is located in the position apart from the thick-walled portion 20 of the diaphragm 2, and the exerted pressure there is lowered. On the other hand, the influences of the exerted pressures by the two pressurizing jigs are large in the area adjacent to the side wall 1*a* and the thick-walled portion 20, and the exerted pressure there becomes comparatively large.

Specifically, the exerted pressure on the portion of the side wall 1*a* adjacent to the filter part 9 is lowered, the outflow amount of the adhesive 40 from that portion is reduced, and it is possible to prevent the adhesive 40 from reaching to the lower pressurizing jig 42 on the side of the diaphragm 2. On the other hand, the exerted pressure on the portion adjacent to the outer end portion of the channel member 1 is increased, and positive bonding of the diaphragm 2 and the channel member 1 can be obtained with good sealing characteristics.

Figure 4:
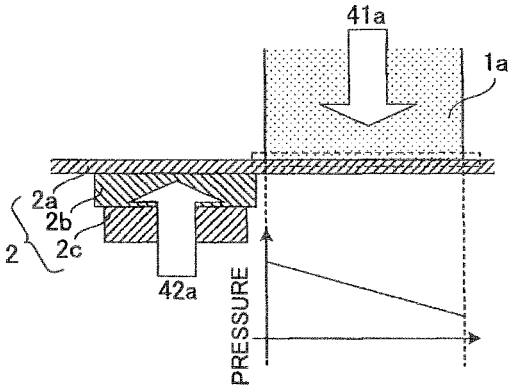
FIG. 4 is an enlarged diagram of a portion of the bonded structure indicated by a one-dot chain line indicated in FIG. 3.

In the present embodiment, the gradient of the exerted pressure can be given as shown in FIG. 4, the bonding strength needed between the diaphragm and the channel member is secured, and the outflow amount of the adhesive for bonding can be reduced.

In the present embodiment, the side wall 1*a* of the channel member 1 which is disposed to contact or located in the vicinity of the filter part 9 formed in the diaphragm 2, and the thick-walled portion 20 which contains the largest number of lamination layers in the diaphragm 2, are arranged so that the side wall 1*a* and the thick-walled portion 20 do not overlap in the laminating direction, and the diaphragm 2 and the channel member 1 are bonded by the adhesive. Thus, the bonding strength needed between the diaphragm 2 and the channel member 1 is secured and the outflow amount of the adhesive for bonding can be reduced.

Figure 6:
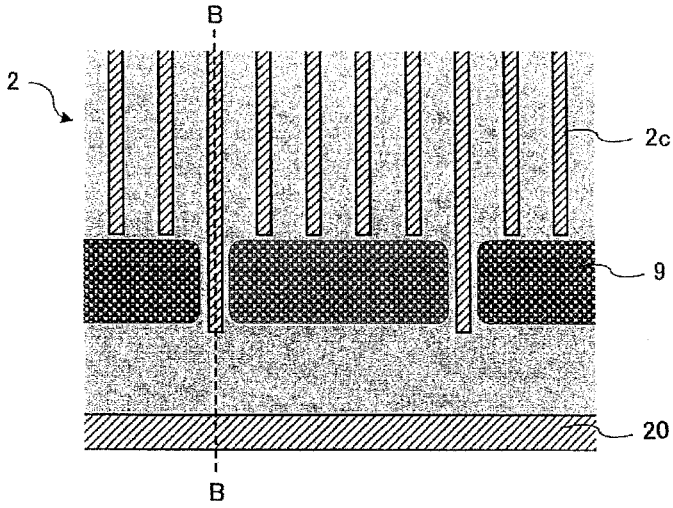
FIG. 6 is a diagram showing a pressurization surface of the diaphragm in the liquid drop ejecting head of the first embodiment when viewed from the side opposite to the channel member side.

Next, FIG. 6 is a diagram showing a pressurization surface of the diaphragm 2 in the liquid drop ejecting device of the present embodiment when viewed from the side opposite to the channel member 1 side. In FIG. 6, shaded hatching lines indicate the third layers 2*c* in the thick-walled portion 20 of the diaphragm 2. The third layers 2*c* in the thick-walled portion 20 arrayed in the nozzle arraying direction are equivalent to the third layers 2*c* of the thick-walled portions 20 arrayed near the partitions which separate the plural pressurizing liquid chambers 6 in the channel member 1.

As shown in FIG. 6, it is preferred that the filter parts 9 are separated for the respective plural pressurizing liquid chambers 6 and arranged to communicate with the plural pressurizing liquid chambers 6. The effective opening area for each pressurizing liquid chamber 6 can be increased, the loss of pressure of the filter part 9 can be reduced, and sufficient amount of the supply liquid can be obtained. Even when some of the filter parts 9 are clogged with foreign substances, the liquid from the common liquid chamber 8 can be supplied through the other filter parts 9, and the performance of liquid drop ejection can be secured with good reliability.

Figure 7:
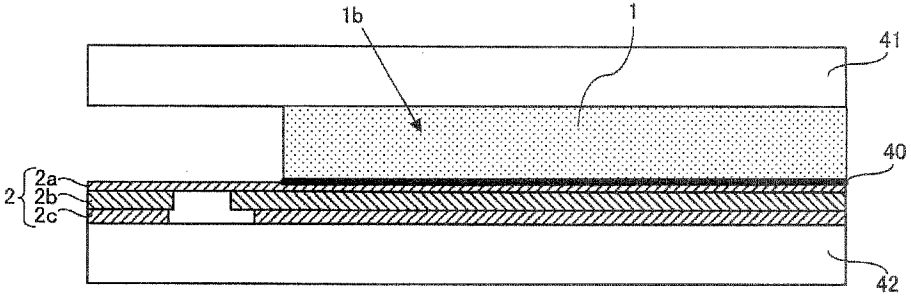
FIG. 7 is a cross-sectional diagram of the diaphragm taken along a line B-B indicated in FIG. 6.

FIG. 7 is a cross-sectional view of the diaphragm taken along a line B-B indicated by a dotted line in FIG. 6. As shown in FIG. 7, a partition 1*b* of the channel member 1 which separates the pressurizing liquid chambers 6, and the thick-walled portion in which the first through third layers 2*a*, 2*b* and 2*c* are laminated are arranged so that the partition 1*b* and the thick-wall portion may overlap each other in the laminating direction. The sealing characteristic of the partition 1*b* and the diaphragm 2 can be secured, and the leaking of the liquid in the pressurizing liquid chamber 6 can be prevented.

Figure 8:
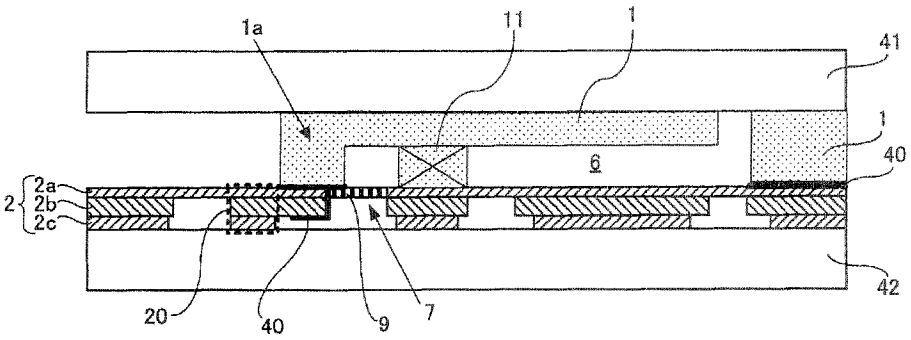
FIG. 8 is a diagram for explaining a bonded structure in which a diaphragm and a channel member are bonded according to a second embodiment of the present disclosure.

Next, a second embodiment of the present disclosure will be described with reference to FIG. FIG. 8 is a cross-sectional diagram for explaining a bonded structure in which a diaphragm 2 and a channel member 1 are bonded according to the second embodiment of the present disclosure.

In the previous embodiment shown in FIG. 3, the diaphragm 2 and the channel member 1 are arranged so that the first through third layers 2*a*-2*c* of the thick-walled portion 20 and the side wall 1*a* may not overlap each other in the laminating direction of the components which form the liquid drop ejecting head. However, in the present embodiment shown in FIG. 8, the second layer 2*b* of the diaphragm 2 and the side wall is overlap each other, and the third layer 2*c* of the diaphragm 2 and the side wall 1*a* do not overlap each other in the laminating direction. Namely, only the third layer 2*c* of the thick-walled portion 20 is not located in a range of projection of the side wall 1*a* in the laminating direction of the components. Otherwise the composition of the present embodiment is the same as the composition of the liquid drop ejecting head of the first embodiment shown in FIG. 3, and a description thereof will be omitted.

Similar to the previous embodiment, in the present embodiment, the thick-walled portion 20 and the side wall 1*a* do not overlap each other, and the gradient of the exerted pressure can be given. Hence, the bonding strength needed between the diaphragm 2 and the channel member 1 is secured, and the outflow amount of the adhesive 40 for bonding can be reduced.

In the composition of the present embodiment, the second layer 2*b* and the side wall 1*a* overlap each other, and the bonding strength higher than that in the composition of the first embodiment can be obtained.

Figure 9:
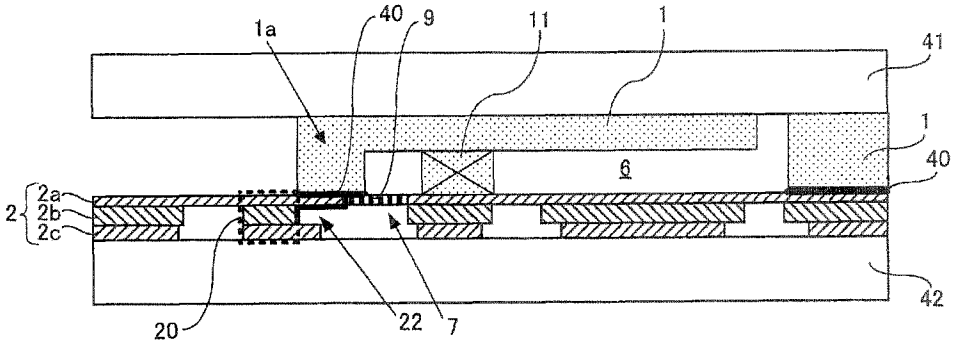
FIG. 9 is a diagram for explaining a bonded structure in which a diaphragm and a channel member are bonded according to a third embodiment of the present disclosure.

Next, a third embodiment of the present disclosure will be described with reference to FIG. 9. FIG. 9 is a cross-sectional diagram for explaining a bonded structure in which a diaphragm 2 and a channel member 1 are bonded according to the third embodiment of the present disclosure.

As shown in FIG. 9, in the composition of the present embodiment, the third layer 2*c* of the diaphragm 2 and the side wall is overlap each other, and the second layer 2*b* and the side wall 1*a* do not overlap each other in the laminating direction. Namely, only the second layer 2*b* of the thick-walled portion 20 is not located in a range of projection of the side wall 1*a* in the laminating direction of the components. In this composition, a recess 22 is formed between the first layer 2*a* and the third layer 2*c* and this recess 22 is open to the side of the filter part 9.

Similar to the first and second embodiments, in the present embodiment, the thick-walled portion 20 and the side wall 1*a* do not overlap each other, and the gradient of the exerted pressure is given. Hence, the bonding strength needed between the diaphragm 2 and the channel member 1 is secured, and the outflow amount of the adhesive 40 for bonding can be reduced.

In the composition of the present embodiment, the adhesive 40 flowing into the side of the thick-walled portion 20 is trapped in the recess 22, and it is possible to certainly prevent the adhesive from reaching to the lower pressurization jig 42.

In the previously described embodiments, the case in which the outflow of the adhesive 40 may occur extensively has been described. However, the present disclosure is not limited to these embodiments. It is preferred to provide a liquid drop ejecting head in which the outflow of the adhesive 40 is prevented in a more restricted manner.

The number of lamination layers in the diaphragm 2 according to the present disclosure is not limited to three layers. Unless the thick-walled portion 20 containing the largest number of lamination layers in the diaphragm 2 and the side wall 1*a* of the channel member 1 overlap each other in the laminating direction, the above-described effects can be obtained.

Next, a fourth embodiment of the present disclosure will be described with reference to FIGS. 10, 11 and 12.

Figure 10:
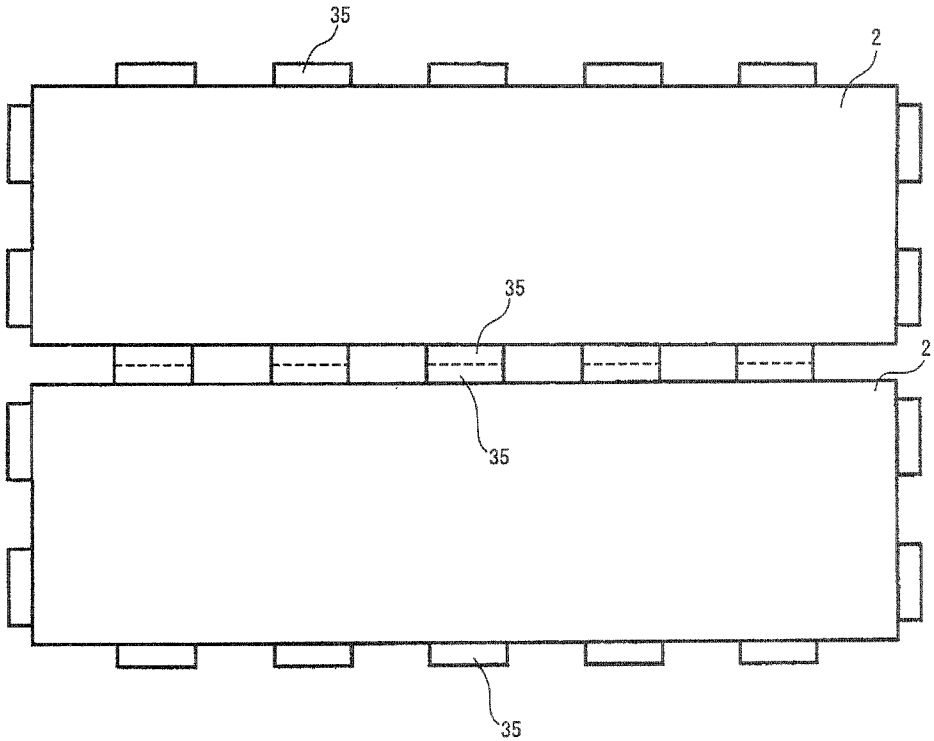
FIG. 10 is a diagram for explaining a function of bridge parts in a diaphragm array in a manufacturing process.

FIG. 10 is a diagram for explaining a function of bridge parts 35 in a diaphragm array in a manufacturing process. FIG. 11 is a diagram for explaining a piece of the diaphragm 2 produced after the bridge parts 35 in the diaphragm array are cut off. FIG. 12 is a diagram showing a pressurization surface of a diaphragm 2 in the liquid drop ejecting head of the fourth embodiment of the present disclosure.

Figure 11:
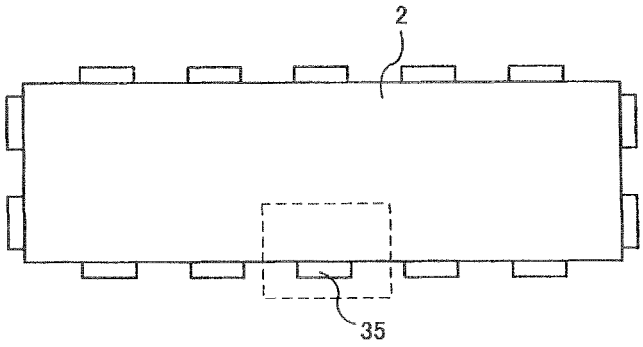
FIG. 11 is a diagram for explaining a piece of diaphragms produced after the bridge parts are cut off.

Referring to FIGS. 10 and 11, the function of the bridge parts 35 in the diaphragm array in the manufacturing process will be described. In order to increase the productivity of producing the laminated-structure diaphragms 2 by electroforming, it is preferred to form plural diaphragms 2 on a substrate at a time. To facilitate handling of the plural diaphragms as a package in the manufacturing process, the bridge parts 35 are formed in the outer periphery of each diaphragm 2 to link the diaphragms 2 together.

Generally, in the manufacturing process, after the bridge parts 35 are cut off along a line indicated by a dotted line in FIG. 10 to produce pieces of diaphragms 2, the bridge parts 35 may be left without removal at a time of head assembly in some cases. In other cases, the bridge parts 35 may be completely removed at the time of head assembly.

However, the diaphragm 2 is a component including thin-walled portions, such as the oscillation area 2A or a damper area of the common liquid chamber 8. When the bridge parts 35 are cut off, neighboring areas of the diaphragm 2 around the bridge parts 35 may be excessively deformed, which may produce an insufficient bonding strength.

Specifically, in the example shown in FIG. 11, the bridge parts 35 remain in the diaphragm 2 piece without removal after the bridge parts 35 are cut off. In a neighboring area (indicated by a dotted line in FIG. 11) of the diaphragm 2 piece near one of the bridge parts 35, an excessive deformation may arise due to the stresses at the time of cutting of the bridge parts 35. It is likely that insufficient bonding between the diaphragm 2 piece and the channel member 1 in the neighboring area of the diaphragm 2 piece near the bridge part 35 takes place because the pressure exerted on the excessively deformed area is lowered.

Next, the composition of the diaphragm 2 according to the present embodiment will be described with reference to FIG. 12.

Figure 12:
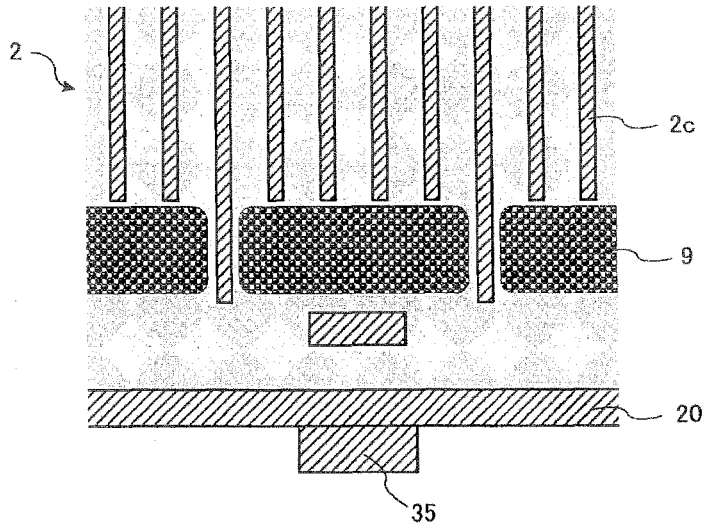
FIG. 12 is a diagram showing a pressurization surface of a diaphragm in a liquid drop ejecting head of a fourth embodiment of the present disclosure.

As shown in FIG. 12, in the present embodiment, the thick-walled portion 20 of the diaphragm 2 (in which the first through third layers 2*a*, 2*b* and 2*c* are laminated) is disposed in the position that faces the bridge part 35. Hence, it is possible to positively pressurize the excessively deformed area of the diaphragm 2 on the thick-walled portion 20, and the occurrence of insufficient bonding can be reduced.

As described above, the liquid drop ejecting head of the present disclosure generally includes: the nozzle plate 3 that forms the nozzles 4 to eject liquid drops; the channel member 1 that forms the pressurizing liquid chambers 6 which communicate with the nozzles 4, respectively; and the diaphragm 2 that forms the bottom surface of each pressurizing liquid chamber 6. The method of manufacturing the liquid drop ejecting head of the present disclosure generally includes: forming the diaphragm 2 to have a laminated structure in which the number of lamination layers is varied at different locations of the diaphragm 2; forming the filter part 9 having the plural filtering holes in the opening 7 of the diaphragm 2 for supplying the liquid to the pressurizing liquid chambers 6; applying the adhesive 40 to the interface surfaces of the channel member 1 and the diaphragm 2; arranging the thick-walled portion 20 containing the largest number of lamination layers in the diaphragm 2 and the side wall 1*a* of the channel member 1 disposed to contact or located in the vicinity of the filter part 9, so that the thick-walled portion 20 and the side wall 1*a* do not overlap each other in the laminating direction; and pressurizing the side wall 1*a* and the thick-walled portion 20 to bond the channel member 1 and the diaphragm 2 together by the adhesive 40.

Next, an image forming device 50 of the present disclosure will be described.

Figure 13:
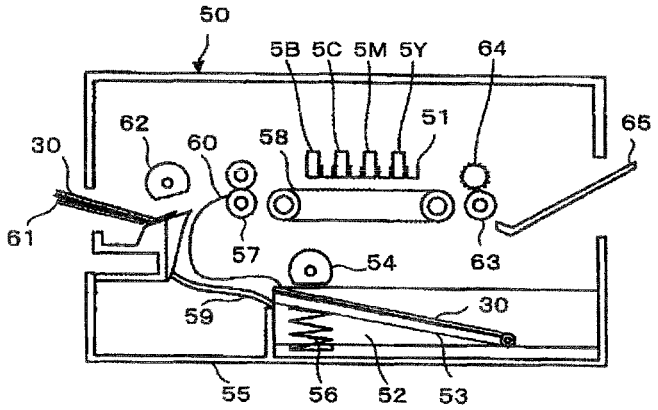
FIG. 13 is a diagram showing an example of an image forming device of the present disclosure.

The image forming device 50 of the present disclosure includes the liquid drop ejecting head of the present disclosure as described above. FIG. 13 is a diagram showing an example of the image forming device 50 of the present disclosure. A side view of a mechanical composition of the image forming device 50 is illustrated in FIG. 13.

As shown in FIG. 13, the image forming device 50 includes four liquid drop ejecting heads 5B, 5C, 5M and 5Y of the present disclosure corresponding to four colors of black (B), cyan (C), magenta (M) and yellow (Y), respectively. In a vicinity of the liquid drop ejecting heads 5B, 5C, 5M and 5Y, a head maintenance unit 51 is arranged and this head maintenance unit 51 is moved to a position which faces a nozzle surface of the corresponding liquid drop ejecting head when maintenance operations, such as a purging operation and a wiping operation, are performed. Each of the liquid drop ejecting heads 5B, 5C, 5M and 5Y is a line type head including nozzle rows that have a length larger than a width of a printing area of a print medium.

A sheet feeding tray 52 is provided with a pressure plate 53 and a feeding roller 54 to feed a printing sheet 30. The pressure plate 53 and the feeding roller 54 are mounted on a base 55. The pressure plate 53 is rotatable around a rotary shaft fixed to the base 55 and pressed onto the feeding roller 54 by a spring 56 fixed to the base 55. In order to prevent the supplying of plural printing sheets 30, a separator pad (which is not illustrated) made of a friction material, such as an artificial skin, which has a high friction coefficient, is arranged at a part of the pressure plate 53 facing the feeding roller 54. In addition, a releasing cam (which is not illustrated) is arranged to disengage the pressure plate 53 from the feeding roller 54.

The releasing cam is arranged to depress the pressure plate 53 to a given lower position when the image forming device 50 is in a standby state. In this condition, the engagement of the pressure plate 53 and the feeding roller 54 is canceled by the releasing cam. If a driving force of a conveyance roller 57 is transmitted to the feeding roller 54 and the releasing cam via gears in this case, the releasing cam is separated from the pressure plate 53 and the pressure plate 53 is lifted toward the feeding roller 54 by the spring 56. At this time, the printing sheet 30 contacts the feeding roller 54, and with rotation of the feeding roller 54, the printing sheet 30 is picked up and fed toward a platen roller 58.

The feeding roller 54 is rotated to send the printing sheet 30 to the platen roller 58. The printing sheet 30 passes through a passage between guide parts 59 and 60 and is sent to the conveyance roller 57. The printing sheet 30 is transported to the platen roller 58 by the conveyance roller 57.

Thereafter, the image forming device 50 is again in the standby state in which the engagement of the pressure plate 53 and the feeding roller 54 is canceled, and the driving force of the conveyance roller 57 is cut off.

In addition, a printing sheet 30 supplied from a manual bypass tray 61 is also transported from the conveyance roller 57 to the platen roller 58 with the rotation of a feeding roller 62. An image is formed on the printing sheet by the liquid drop ejecting heads 5B, 5C, 5M and 5Y in accordance with control signals, such that the printing sheet 30 is transported by the platen roller 58 in a controlled timing that is synchronized with the liquid drop ejection of the liquid drop ejecting heads. The printing sheet 30 on which the image is printed is transported by an ejection roller 63 and a spur 64, so that the printing sheet 30 is ejected to a sheet output tray 65. In this manner, a desired image can be speedily formed on the printing sheet 30 by using the line type liquid drop ejecting heads 5B, 5C, 5M, and 5Y.

Figure 14:
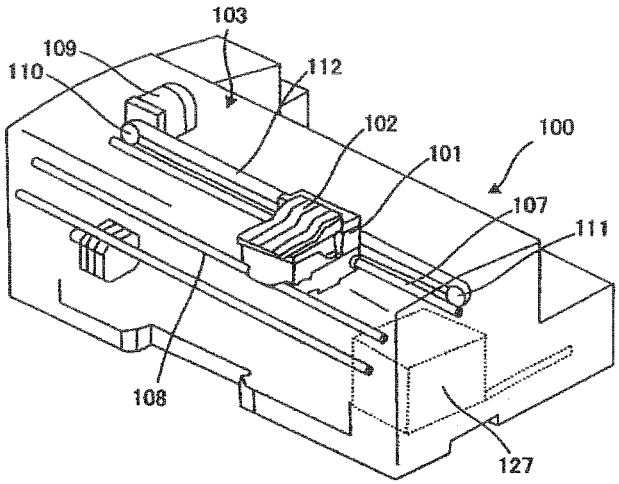
FIG. 14 is a perspective view of another example of the image forming device of the present disclosure.

Next, another example of the image forming device including the liquid drop ejecting head 5 of the present disclosure will be described with reference to FIGS. 14 and 15. FIG. 14 is a perspective view of an image forming device 100, and FIG. 15 is a cross-sectional diagram showing the composition of the image forming device 100 shown in FIG. 14.

Figure 15:
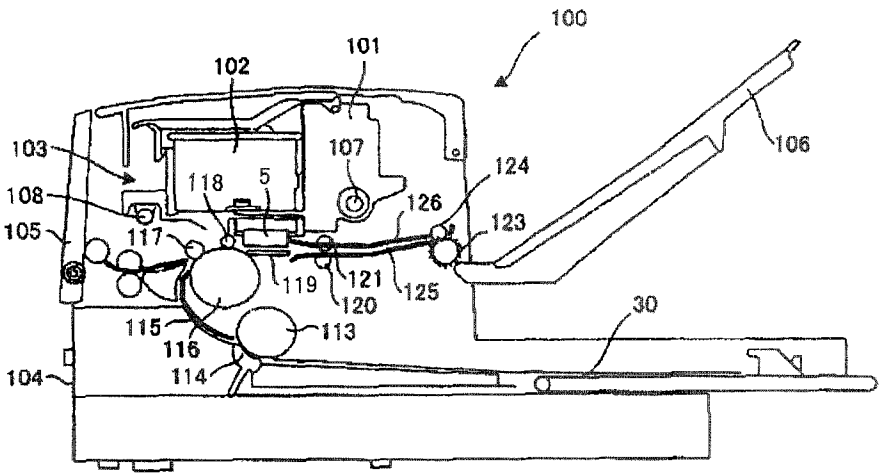
FIG. 15 is a diagram showing the composition of the image forming device shown in FIG. 14.
Figure 16:
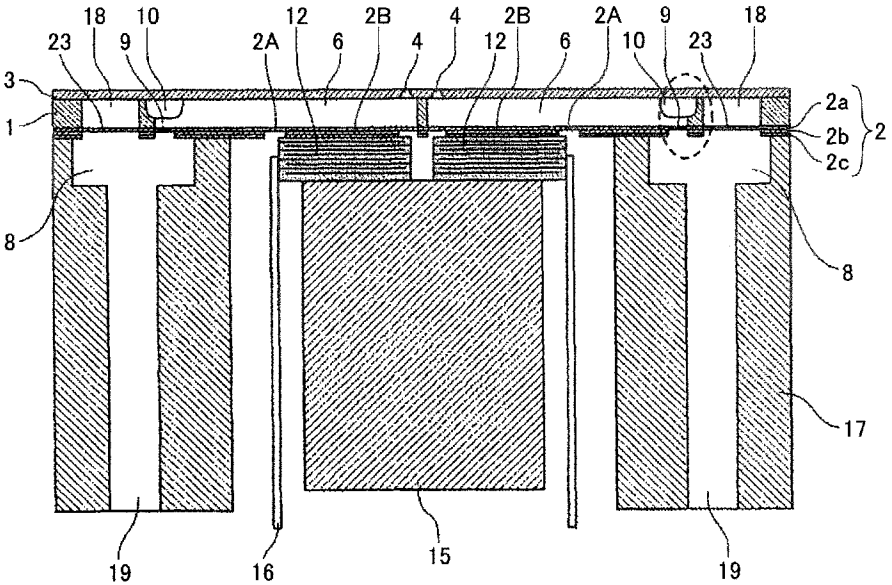
FIG.16 RELATED ART
FIG. 16 is a cross-sectional view of an example of a liquid drop ejecting head according to the related art.

As shown in FIGS. 14 and 15, the image forming device 100 generally includes an image formation unit 103 arranged inside a main body of the image forming device 100, the image formation unit 103 including at least a carriage 101, a liquid drop ejecting head 5 and an ink cartridge 102. The carriage 101 is movable in a main scanning direction inside the image forming device 100. The liquid drop ejecting head 5 is mounted on the carriage 101. The ink cartridge 102 supplies ink to the liquid drop ejecting head 5. A sheet cassette (or sheet feed tray) 104 is detachably attached to a lower part of the main body of the image forming device 100. Plural printing sheets 30 can be loaded into the sheet cassette 104 from a front side of the image forming device 100.

The image forming device 100 includes also a manual bypass tray 105 which is opened in order to manually feed the printing sheet 30 to the image formation unit 103. In the image forming device 100, the printing sheet 30 is supplied from the sheet cassette 104 or the manual bypass tray 105 to the image formation unit 103, and an image is printed on the printing sheet 30 by the image formation unit 103. The printing sheet 30 after the image is printed thereon is transported to a sheet ejection tray 106 arranged on the rear side of the main body.

The image formation unit 103 includes a primary guide rod 107 and a secondary guide rod 108 which are secured to right and left side plates (not illustrated) and function as guide members for the carriage 101. The carriage 101 is slidably held on the primary guide rod 107 and the secondary guide rod 108 to be movable in the main scanning direction.

In this carriage 101, the liquid drop ejecting head 5 which ejects ink drops of each color of yellow (Y), cyan (C), magenta (M) and black (B) is arranged. In the liquid drop ejecting head 5, plural ink ejection holes (nozzles) are arrayed in a direction which intersects the main scanning direction, and the ink drop ejecting surface of the liquid drop ejecting head 5 is directed to the downward direction. Four ink cartridges 102 are attached to the carriage 101, and each of the ink cartridges 102 is to supply the ink of the corresponding one of the four colors to the liquid drop ejecting head 5. Each of the ink cartridges 102 is exchangeable.

An air opening is formed in an upper part of each ink cartridge 102 to communicate with the atmosphere, and an ink supply opening is formed in a lower part of each ink cartridge 102 to supply ink to the liquid drop ejecting head 5. An ink-filled porous material is contained in each ink cartridge 102, and a pressure of the ink supplied to the liquid drop ejecting head 5 is maintained at a small negative pressure by the capillary effect of the porous material. In the present embodiment, the liquid drop ejecting head 5 may include four liquid drop ejecting heads corresponding to four colors of black (B), cyan (C), magenta (M) and yellow (Y), respectively. Alternatively, the liquid drop ejecting head 5 may be a single liquid drop ejecting head including four nozzle members having nozzles for ejecting ink drops of the four colors, respectively.

The rear side portion of the carriage 101 (or the downstream side of the sheet transport direction) is slidably fitted to the primary guide rod 107 and the front side portion of the carriage 101 (or the upstream side of the sheet transport direction upstream) is slidably fitted to the secondary guide rod 108. In order to move the carriage 101 in the main scanning direction, a drive pulley 110, an idler pulley 111 and a timing belt 112 are disposed. The timing belt 112 is stretched between the drive pulley 110 and the idler pulley 111, and the drive pulley 110 is rotated by a main scanning motor 109. The timing belt 112 is fixed to the carriage 101. The two-directional movement of the carriage 101 in the main canning direction is carried out by forward and backward rotation of the main scanning motor 109.

On the other hand, in order to transport the printing sheet 30 from the sheet cassette 104 to the position beneath the liquid drop ejecting head 5, a sheet feeding roller 113 and a friction pad 114 are disposed to pick up the printing sheet 30 from the sheet cassette 104 and send the printing sheet 30. Further, a guide member 115, a conveyance roller 116, a conveyance roller 117, and an end roller 118 are disposed. The guide member 115 functions to guide the printing sheet 30. The conveyance roller 116 functions to reverse the printing sheet 30 and transport the printing sheet 30. The conveyance roller 117 is forced onto the outer peripheral surface of the conveyance roller 116. The end roller 118 functions to specify the transporting angle of the printing sheet 30 from the conveyance roller 116. The conveyance roller 116 is rotated by a sub-scanning motor (not illustrated) via a gear train (not illustrated).

A sheet supporting member 119 is disposed beneath the liquid drop ejecting head 5 to cover the moving range of the carriage 101 in the main scanning direction. This sheet supporting member 119 is a sheet guide member to guide the printing sheet 30 sent from the conveyance roller 116 on the upper surface of the sheet supporting member 119. On a downstream side of the sheet supporting member 119 in the sheet transport direction, a conveyance roller 120 and a spur 121 are disposed, and the conveyance roller 120 and the spur 121 are rotated to send the printing sheet 30 to a sheet ejection passage. Guide members 125 and 126 are disposed to form the sheet ejection passage. A delivery roller 123 and a spur 124 are disposed at the and of the sheet ejection passage to send the printing sheet 30 to the sheet ejection tray 106.

When the image forming device 100 performs a printing job, while the carriage 101 is moved, the liquid drop ejecting head 5 is driven in accordance with an image signal to eject ink drops to the printing sheet 30 (which is stopped on the sheet supporting member 119), so that an image is printed on the printing sheet 30 by one line. Thereafter, the printing sheet 30 is moved in a sub-scanning direction by a given transport amount and then the image forming device 100 prints the following line of the image on the printing sheet 30. When a print end signal or a detection signal indicating arrival a back end of the printing sheet 30 at the printing area is received, the image forming device 100 terminates the printing operation, and transports the printing sheet 30 to the sheet ejection tray 106.

As shown in FIG. 14, in a right end portion of the main body in the carriage moving direction of the carriage 101 which is located outside the printing area, a recovery device 127 is disposed for recovering from insufficient ejection of the liquid drop ejecting head 5. The recovery device 127 includes a capping unit, a suction unit and a cleaning unit. In a standby state of the image forming device 100 before printing, the carriage 101 is moved to the right end portion where the recovery device 127 is disposed. The recovery device 127 performs capping of the liquid drop ejecting head 5 by the capping unit to maintain the ejection hole surface of the liquid drop ejecting head 5 in a wet condition and prevent insufficient ejection due to dryness of ink. In addition, during a printing job of the image forming device 100, the liquid drop ejecting head 5 ejects ink drops which are not related to the printing job, in order to keep ink viscosity of all the ejection holes constant, so that stable ejection performance of the liquid drop ejecting head 5 is maintained.

If insufficient ejection occurs, the ejection holes (nozzles) of the liquid drop ejecting head 5 are sealed by the capping unit, and the ink and air bubbles are suctioned from the ejection holes by the suction unit via a tube. The ink, dust, etc. adhering to the ejection hole surface are removed by the cleaning unit and the insufficient ejection is recovered from. The ink is supplied from the suction unit to a used ink tank (not illustrated) disposed in the lower part of the main body. The supplied ink is absorbed and stored in an ink absorber in the used ink tank.

In the foregoing embodiments, the image forming device 50 shown in FIG. 13 and the image forming device 100 shown in FIGS. 14 and 15 have been described. However, the present disclosure is not limited to these embodiments. Alternatively, the liquid drop ejecting head 5 of the present disclosure may be applied to an image forming device which ejects liquid drops other than ink drops, such as liquid drops of patterning resist.

According to the image forming device including the liquid drop ejecting head of the present disclosure, the nozzle clogging or the ejection deviation of liquid drops being ejected due to foreign substances mixed in a liquid, such as ink, can be prevented, and an image can be formed on a printing sheet with high quality.

According to the present disclosure, it is possible to provide a liquid drop ejecting head in which a bonding strength needed between the diaphragm and the channel member is secured and the outflow of the adhesive for bonding is prevented.

The liquid drop ejecting head of the present disclosure is not limited to the specifically disclosed embodiments, and variations and modifications may be made without departing from the scope of the present disclosure.

The present application is based upon and claims the benefit of priority of Japanese Patent Application No. 2012-062096, filed on Mar. 19, 2012, and Japanese Patent Application No. 2012-243511, filed on Nov. 5, 2012, the contents of which are incorporated herein by reference in their entirety.

What is claimed is:

1. A liquid drop ejecting head comprising:

a nozzle plate that forms nozzles to eject liquid drops;

a channel member that forms pressurizing liquid chambers which communicate with the nozzles, respectively; and a diaphragm that forms a bottom surface of each of the pressurizing liquid chambers, the diaphragm, the channel member and the nozzle plate being laminated on top of each other, wherein:

an interface surface of a side wall of the channel member and an interface surface of the diaphragm are bonded by an adhesive;

the diaphragm is formed to have a laminated structure in which the number of lamination layers is varied at different locations of the diaphragm;

the diaphragm includes an opening and a filter part, the filter part having plural filtering holes formed in the opening for supplying a liquid to the pressurizing liquid chambers;

the side wall of the channel member is disposed to contact or located in a vicinity of the filter part, the side wall and a thick-walled portion containing the largest number of lamination layers in the diaphragm do not overlap with each other in a laminating direction; and a distance between the thick-walled portion and the filter part is greater than a distance between the side wall of the channel member and the filter part in a direction perpendicular to a nozzle arraying direction in which the nozzles are arrayed.

2. The liquid drop ejecting head according to claim 1, wherein the thick-walled portion is formed in the diaphragm and located nearer to an outer peripheral end of the liquid drop ejecting head than the side wall of the channel member so that the thick-walled portion and the side wall do not overlap with each other in the laminating direction.

3. The liquid drop ejecting head according to claim 1, wherein the diaphragm has a laminated structure containing three layers joined on top of each other and the thick-walled portion contains a first layer in which the filter part is formed, a second layer laminated on the first layer, and a third layer laminated on the second layer.

4. The liquid drop ejecting head according to claim 1, wherein a partition of the channel member which separates the pressurizing liquid chambers, and the thick-walled portion of the diaphragm are arranged so that the partition and the thick-walled portion overlap each other in the laminating direction.

5. An image forming device comprising:

the liquid drop ejecting head according to claim 1; and an image formation unit on which the liquid drop ejecting head is mounted.

6. A liquid drop ejecting head comprising:

a nozzle plate that forms nozzles to eject liquid drops;

a channel member that forms pressurizing liquid chambers which communicate with the nozzles, respectively; and a diaphragm that forms a bottom surface of each of the pressurizing liquid chambers, the diaphragm, the channel member and the nozzle plate being laminated on top of each other, wherein:

interface surfaces of the channel member and the diaphragm are bonded by an adhesive;

the diaphragm is formed to have a laminated structure in which the number of lamination layers is varied at different locations of the diaphragm;

the diaphragm includes an opening and a filter part, the filter part having plural filtering holes formed in the opening for supplying a liquid to the pressurizing liquid chambers; and a side wall of the channel member is disposed to contact or located in a vicinity of the filter part, and the side wall and a thick-walled portion containing the largest number of lamination layers in the diaphragm do not overlap with each other in a laminating direction, and wherein the diaphragm has a laminated structure containing three layers joined on top of each other and the thick-walled portion contains a first layer in which the filter part is formed, a second layer laminated on the first layer, and a third layer laminated on the second layer, and wherein the first layer and the second layer of the thick-walled portion overlap with the side wall of the channel member in the laminating direction, and the third layer does not overlap with the side wall in the laminating direction.

7. A liquid drop ejecting head comprising:

a nozzle plate that forms nozzles to eject liquid drops;

a channel member that forms pressurizing liquid chambers which communicate with the nozzles, respectively; and a diaphragm that forms a bottom surface of each of the pressurizing liquid chambers, the diaphragm, the channel member and the nozzle plate being laminated on top of each other, wherein:

interface surfaces of the channel member and the diaphragm are bonded by an adhesive;

the diaphragm is formed to have a laminated structure in which the number of lamination layers is varied at different locations of the diaphragm;

the diaphragm includes an opening and a filter part, the filter part having plural filtering holes formed in the opening for supplying a liquid to the pressurizing liquid chambers; and a side wall of the channel member is disposed to contact or located in a vicinity of the filter part, and the side wall and a thick-walled portion containing the largest number of lamination layers in the diaphragm do not overlap with each other in a laminating direction, and wherein the diaphragm has a laminated structure containing three layers joined on top of each other and thick-walled portion contains a first layer in which the filter part is formed, a second layer laminated on the first layer, and a third layer laminated on the second layer, and wherein the first layer and the third layer of the thick-walled portion overlap with the side wall of the channel member in the laminating direction, and the second layer does not overlap with the side wall in the laminating direction.

8. A method of manufacturing a liquid drop ejecting head, the liquid drop ejecting head including a diaphragm, a channel member and a nozzle plate which are laminated on top of each other, the method comprising:

forming the diaphragm to have a laminated structure in which the number of lamination layers is varied at different locations;

forming a filter part having plural filtering holes in an opening of the diaphragm for supplying a liquid to pressurizing liquid chambers of the channel member;

applying an adhesive to interface surfaces of the channel member and the diaphragm;

arranging a thick-walled portion containing the largest number of lamination layers in the diaphragm and a side wall of the channel member disposed to contact or located in a vicinity of the filter part, so that the thick-walled portion and the side wall do not overlap each other in a laminating direction; and pressurizing the side wall and the thick-walled portion to bond the channel member and the diaphragm together by the adhesive, wherein a distance between the thick-walled portion and the filter part is greater than a distance between the side wall of the channel member and the filter part in a direction perpendicular to a nozzle arraying direction in which the nozzles are arrayed.

* * * * *